US008600739B2

(12) United States Patent
Zhang et al.

(10) Patent No.: US 8,600,739 B2
(45) Date of Patent: Dec. 3, 2013

(54) CODING METHOD, ENCODER, AND COMPUTER READABLE MEDIUM THAT USES ONE OF MULTIPLE CODEBOOKS BASED ON A TYPE OF INPUT SIGNAL

(75) Inventors: Dejun Zhang, Shenzhen (CN); Liang Zhang, Shenzhen (CN); Yue Lang, Shenzhen (CN); Tinghong Wang, Shenzhen (CN); Lixiong Li, Shenzhen (CN); Wenhai Wu, Shenzhen (CN); Wei Xiao, Shenzhen (CN); Fuwei Ma, Shenzhen (CN); Zexin Liu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 1212 days.

(21) Appl. No.: 12/481,060

(22) Filed: Jun. 9, 2009

(65) Prior Publication Data

US 2009/0248406 A1 Oct. 1, 2009

Related U.S. Application Data

(63) Continuation of application No. PCT/CN2008/072371, filed on Sep. 16, 2008.

(30) Foreign Application Priority Data

Nov. 5, 2007 (CN) ..... 2007 1 0165784

(51) Int. Cl.
*G10L 19/24* (2013.01)

(52) U.S. Cl.
USPC ..... 704/223

(58) Field of Classification Search
USPC ..... 704/223
See application file for complete search history.

(56) References Cited

U.S. PATENT DOCUMENTS 5,187,745 A 2/1993 Yip et al.
5,202,953 A 4/1993 Taguchi (Continued)

FOREIGN PATENT DOCUMENTS

CN 1181151 A 5/1988
CN 1141684 A 1/1997

(Continued)

OTHER PUBLICATIONS

European Patent Office Communication pursuant to Rule 115(1) EPC, Summons to Attend Oral Proceedings dated (mailed) Dec. 20, 2010, for Application No. 08800868.5-1224 / 2110808, filed Sep. 16, 2008, Huawei Technologies C., LTD.

(Continued)

*Primary Examiner* — Susan McFadden
(74) *Attorney, Agent, or Firm* — Conley Rose, P.C.; Grant Rodolph; Nicholas K. Beaulieu

(57) ABSTRACT

A coding method is adapted to select different codebook search algorithms according to varied types of input signals. An encoder using the coding method is also provided. As appropriate search algorithms may be selected according to all possible structural features of the input signals, certain types of signals for which satisfactory results may be obtained through simple computations may match with search algorithms suitable for these signal types and having low computation complexities, so as to achieve better performance with fewer system resources. Meanwhile, other types of signals that need complicated computations may be processed by more sophisticated search algorithms, thereby ensuring the coding quality.

19 Claims, 8 Drawing Sheets

(56) References Cited

U.S. PATENT DOCUMENTS

| | | | | |
|---|---|---|---|---|
| 5,444,816 | A | 8/1995 | Adoul et al. | |
| 5,699,482 | A | 12/1997 | Adoul et al. | |
| 5,701,392 | A | 12/1997 | Adoul et al. | |
| 5,754,976 | A | 5/1998 | Adoul et al. | |
| 5,822,724 | A | 10/1998 | Nahumi | |
| 5,950,155 | A | 9/1999 | Nishiguchi | |
| 6,393,391 | B1 | 5/2002 | Ozawa | |
| 6,480,822 | B2 | 11/2002 | Thyssen | |
| 6,510,407 | B1 | 1/2003 | Wang | |
| 6,581,031 | B1 | 6/2003 | Ito et al. | |
| 6,631,347 | B1 | 10/2003 | Kim et al. | |
| 6,928,406 | B1 | 8/2005 | Ehara et al. | |
| 7,065,338 | B2 * | 6/2006 | Mano et al. | 455/313 |
| 7,206,739 | B2 | 4/2007 | Lee | |
| 8,373,693 | B2 | 2/2013 | Ishiguchi | |
| 2002/0029140 | A1 | 3/2002 | Ozawa | |
| 2003/0007877 | A1 | 1/2003 | Kurita et al. | |
| 2003/0033136 | A1 | 2/2003 | Lee | |
| 2003/0046067 | A1 | 3/2003 | Gradl | |
| 2004/0093203 | A1 | 5/2004 | Lee et al. | |
| 2004/0093204 | A1 | 5/2004 | Byun et al. | |
| 2004/0093368 | A1 | 5/2004 | Lee et al. | |
| 2004/0172402 | A1 | 9/2004 | Jabri et al. | |
| 2004/0181400 | A1 | 9/2004 | Kannan et al. | |
| 2004/0193410 | A1 | 9/2004 | Lee et al. | |
| 2005/0065785 | A1 | 3/2005 | Bessette | |
| 2007/0136054 | A1 | 6/2007 | Kim et al. | |
| 2010/0088091 | A1 | 4/2010 | Lee et al. | |

FOREIGN PATENT DOCUMENTS

| | | | |
|---|---|---|---|
| CN | 1395724 | A | 2/2003 |
| CN | 1158648 | | 7/2004 |
| CN | 1547193 | A | 11/2004 |
| CN | 1760905 | A | 4/2006 |
| CN | 1760975 | A | 4/2006 |
| CN | 1766988 | A | 5/2006 |
| CN | 100578619 | | 6/2010 |
| EP | 0 753 841 | A2 | 1/1997 |
| EP | 1221694 | A1 | 7/2002 |
| JP | 9146599 | A | 6/1997 |
| JP | 9179593 | A | 7/1997 |
| JP | 09-265300 | | 10/1997 |
| JP | 9-265300 | | 10/1997 |
| JP | 2000163096 | A | 6/2000 |
| JP | 2000322097 | A | 11/2000 |
| JP | 2006504123 | A | 2/2006 |
| KR | 10-2007-0061193 | | 6/2007 |
| KR | 20070061193 | A | 6/2007 |
| WO | WO-0120595 | A1 | 3/2001 |
| WO | WO-2004/038924 | A1 | 5/2004 |

OTHER PUBLICATIONS

Korean Office Action dated (mailed) Nov. 19, 2010, issued in related Korean Application No. 10-2009-7012209, Huawei Technologies Co., LTD.

Written Opinion of the International Searching Authority (translation) dated (mailed) Dec. 25, 2008, issued in related Application No. PCT/CN2008/072371, filed Sep. 16, 2008, Huawei Technologies Co., Ltd.

European Patent Office Communication pursuant to Article 94(3) EPC, European search opinion for Application No. 08800868.5-1224, mailed Apr. 26, 2010, Huawei Technologies C., LTD 6 pgs.

International Search Report from P.R. China in International Application No. PCT/CN2008/072371 mailed Dec. 25, 2008.

Japanese Office Action dated (mailed) Nov. 8, 2008, issued in related Japanese Application No. 2009-539594 (3 pgs.).

Korean Office Action dated Aug. 31, 2011, issued in related Korean Application No. 10-2009-7012209 for Huawei Technologies Co., Ltd. (2 pgs.).

Foreign Communication From a Counterpart Application, Japanese Application 2009-539594, English Translation of Japanese Office Action dated Oct. 2, 2012, 2 pages.

Foreign Communication From a Counterpart Application, Japanese Application 2009-539594, Japanese Office Action dated Nov. 4, 2011, 2 pages.

Chinese Office Action dated May 8, 2009, in related Chinese Application No. 2007101657843, with English translation.

EPO Communication enclosing an extended European Search Report which includes, pursuant to Rule 62 EPC, the supplementary European Search Report and the European search opinion for Application No. 08800868.5, dated Dec. 10, 2009, 8 pgs.

Lee, Eung-Don et al, "Efficient Fixed Codebook Search Method for ACELP Speech Codecs", Advances in Hybrid Information Technology: Lecture Notes in Computer Science, Nov. 9, 2006, Springer-Verlag Berlin Heidelberg, pp. 178-187.

Foreign Communication From a Counterpart Application, Japanese Application No. 2009539594, Japanese Official Inquiry dated May 28, 2013, 3 pages.

Foreign Communication From a Counterpart Application, Japanese Application No. 2009539594, English Translation of Japanese Official Inquiry dated May 28, 2013, 4 pages.

* cited by examiner

CODING METHOD, ENCODER, AND COMPUTER READABLE MEDIUM THAT USES ONE OF MULTIPLE CODEBOOKS BASED ON A TYPE OF INPUT SIGNAL

CROSS-REFERENCE TO RELATED APPLICATIONS

This application is a continuation of International Patent Application No. PCT/CN2008/072371, filed Sep. 16, 2008, and entitled "CODING METHOD, ENCODER, AND COMPUTER READABLE MEDIUM", which claims the benefit of priority to Chinese Patent Application No. 200710165784.3, filed Nov. 5, 2007, and entitled "CODING METHOD AND ENCODER", both of which are incorporated herein by reference in their entireties.

FIELD OF THE DISCLOSURE

The present disclosure relates to a vector coding technology, and more particularly to a coding method, an encoder, and a computer readable medium.

BACKGROUND

In a coding technology based on a code excited linear prediction (CELP) model, it is a very important process to perform quantization coding on residual signals after adaptive filtering. Currently, quantization coding of the residual signals is often performed through fixed codebook searching. A commonly used fixed codebook is an algebraic codebook. The algebraic codebook focuses on pulse positions of target signals, and sets the pulse amplitude to 1 by default, so that only the symbols and positions of the pulses need to be quantified. Certainly, multiple pulses may be superposed at the same position to denote different amplitudes. When the algebraic codebook is employed for quantization coding, it is important to search positions of pulses in the optimal algebraic codebook corresponding to the target signal. Generally, during the search for optimal positions of the pulses, the computation of a full search (that is, to traverse all possible position combinations) is quite complicated, and thus a sub-optimal search algorithm is needed. On the basis of ensuring the quality of the search result, how to reduce the search times and lower down the computation complexity is the main issue to be studied and solved in the coding technology.

Two existing sub-optimal search methods for searching pulse positions in an algebraic codebook are described as follows.

1. Depth-First Tree Search Procedure

It is assumed that the length of a speech sub-frame is 64 and a pulse number to be searched is N which changes with the code rate. With no other restrictions, the computation for searching N pulses in 64 positions is highly complicated. Therefore, the pulse positions in the algebraic codebook are restrained, and the 64 positions are divided into M tracks. A typical method for dividing the tracks is shown in Table 1.

TABLE 1

| Track | Positions |
|---|---|
| T0 | 0, 4, 8, 12, 16, 20, 24, 28, 32, 36, 40, 44, 48, 52, 56, 60 |
| T1 | 1, 5, 9, 13, 17, 21, 25, 29, 33, 37, 41, 45, 49, 53, 57, 61 |
| T2 | 2, 6, 10, 14, 18, 22, 26, 30, 34, 38, 42, 46, 50, 54, 58, 62 |
| T3 | 3, 7, 11, 15, 19, 23, 27, 31, 35, 39, 43, 47, 51, 55, 59, 63 |

In Table 1, "T0" to "T3" are four tracks, and "Positions" are position numbers on each track. It is known from Table 1, 64 positions are divided into 4 tracks, each track has 16 positions, and pulse positions on the four tracks are staggered, so as to ensure various combinations of the pulse positions to the maximum.

The N pulses to be searched are restrained on M=4 tracks based on a certain quantity distribution. For example, N=4 and one pulse is searched on each track. Other circumstances may be deduced likewise.

It is assumed that the pulses to be searched on T0 to T3 are respectively P0 to P3. During the search, two pulses on two adjacent tracks are searched at a time, for example, T0-T1, T1-T2, T2-T3, and T3-T0, so that a final optimal codebook is obtained through a four-level search. The detailed process is shown in FIG. 1, which includes the following steps.

1) A first level search is performed on T0-T1 and T2-T3. Firstly, positions of P0 and P1 are searched on T0-T1, in which P0 is searched from 4 positions among 16 positions on the track T0, the 4 positions are determined by extreme values of known reference signals on the track, and P1 is searched from 16 positions on the track T1. Optimal positions of P0 and P1 are determined from the searched 4×16 position combinations according to a set evaluation criterion (for example, a cost function Qk). Afterward, the positions of P2 and P3 are searched on T2-T3, in which P2 is searched from 8 positions among 16 positions on the track T2, the 8 positions are determined by extreme values of known reference signals on the track, and P3 is searched from 16 positions on the track T3, so that the optimal positions of P2 and P3 are determined. Thus, the search process on this level is completed.

2) A second level search is performed on T1-T2 and T3-T0, which is similar to the first level search.

3) A third level search is performed on T2-T3 and T0-T1, and a fourth level search is performed on T3-T0 and T1-T2 similarly.

4) Finally, an optimal result is selected from the four-level search as an optimal algebraic codebook. The total search times are 4×(4×16+8×16)=768.

2. Global Pulse Replacement Procedure

For ease of illustration, it is assumed that the same codebook structure as that of the previous algorithm is used, one pulse is searched on each of the 4 tracks, and the pulses searched on T0 to T3 are respectively P0 to P3. The detailed process includes the following steps.

1) An initial codebook is determined, which is assumed to be {P0, P1, P2, P3}={20, 33, 42, 7}. P1, P2, and P3 remain unchanged, the initial value 20 of P0 is sequentially replaced by other positions on the track T0, so as to obtain new codebooks {0, 33, 42, 7}, {4, 33, 42, 7}, . . . , {60, 33, 42, 7}. According to a set evaluation criterion, an optimal new codebook is selected, for example, a new codebook having a maximum Qk value of the cost function is selected. The maximum Qk value and the corresponding new codebook are recoded, for example, {4, 33, 42, 7}.

2) P0, P2, and P3 in the initial codebook remain unchanged (it should be noted that the initial codebook here is still the original initial codebook, i.e., {20, 33, 42, 7}), the initial value 33 of P1 is sequentially replaced by other positions on the track T1, which is similar to the process in 1), so as to obtain a maximum Qk value and a corresponding new codebook, for example, {20, 21, 42, 7} through the replacement.

3) Processes similar to 1) and 2) are performed on P2 and P3, so as to respectively obtain a maximum Qk value and a corresponding new codebook.

4) A maximum value is selected from the obtained four maximum Qk values as a global optimal value, and the corresponding codebook, for example, {20, 21, 42, 7}, serves as an optimal codebook for the search of this round.

5) The optimal codebook {20, 21, 42, 7} is taken as an initial codebook for a new round, the processes from 1) to 4) are then repeated, and this cycle is generally performed for four times to obtain a final optimal codebook. Therefore, the total search times are 4×(4×16)=256

It is difficult for the codebook search algorithms used in various existing coding technologies to meet the requirements for computation complexity and performance. For example, though the depth-first tree search algorithm obtains a desired speech quality under various code rates, the search times are large, and the computation complexity is high. In addition, though the global pulse replacement algorithm has a low computation complexity, a local maximum value may occur, so that the performance is unstable. That is, the algorithm may achieve a good quality under certain signal conditions, but may fail to achieve an desirable quality under other signal conditions.

SUMMARY OF THE DISCLOSURE

Accordingly, various embodiments of the present disclosure provide a coding method, an encoder, and a computer readable medium capable of lowering computation complexity while improving system performance.

A coding method includes: acquiring a characteristic parameter of an input signal; determining the type of the input signal according to the characteristic parameter; obtaining vectors to be quantified according to the characteristic parameter; and performing a codebook search on the vectors to be quantified with a codebook search algorithm corresponding to the type of the input signal.

An encoder includes: a characteristic parameter acquisition unit adapted to acquire characteristic parameters of an input signal; a signal type determination unit adapted to determine the type of the input signal according to the characteristic parameters; a vector generation unit adapted to generate vectors to be quantified according to the characteristic parameters; and a decision unit adapted to perform a codebook search on the vectors to be quantified with a codebook search algorithm corresponding to the type of the input signal determined by the signal type determination unit.

A computer readable storage medium includes a computer program code. The computer program code is executed by a computer unit, so that the computer unit is configured to acquire characteristic parameters of an input signal, determine the type of the input signal according to the characteristic parameters, obtain vectors to be quantified according to the characteristic parameters, and perform a codebook search on the vectors to be quantified with a codebook search algorithm corresponding to the type of the input signal.

The coding method or device adopts different codebook search algorithms according to varied types of input signals. As an appropriate search algorithm may be selected according to characteristics of the input signal, certain types of signals for which satisfactory results may be obtained through simple computations may match with search algorithms suitable for these signal types and having low computation complexities, so as to achieve better performance with fewer system resources. Meanwhile, other types of signals that need complicated computations may be processed by more sophisticated search algorithms, thereby ensuring the coding quality.

DETAILED DESCRIPTION OF THE EMBODIMENTS

A coding method is provided in an embodiment of the present disclosure, which is capable of selecting different codebook search algorithms according to varied types of input signals. An encoder using the coding method is also provided in an embodiment of the present disclosure. The method and the device of the embodiments of the present disclosure will be respectively described in detail below.

Figure 1:
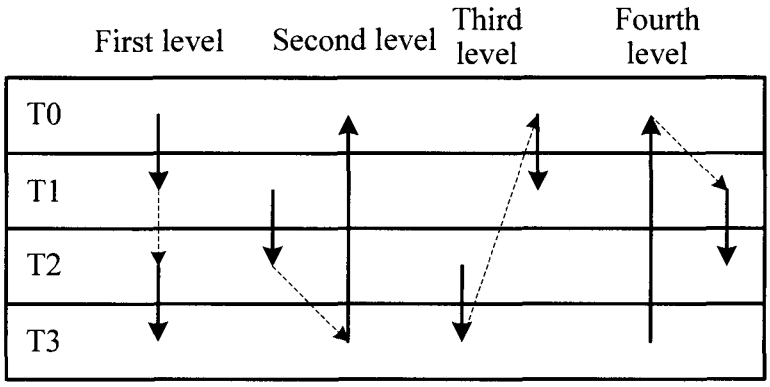
FIG. 1 (Prior Art)
FIG. 1 is a schematic view of a depth-first tree search procedure in the prior art.
Figure 2:
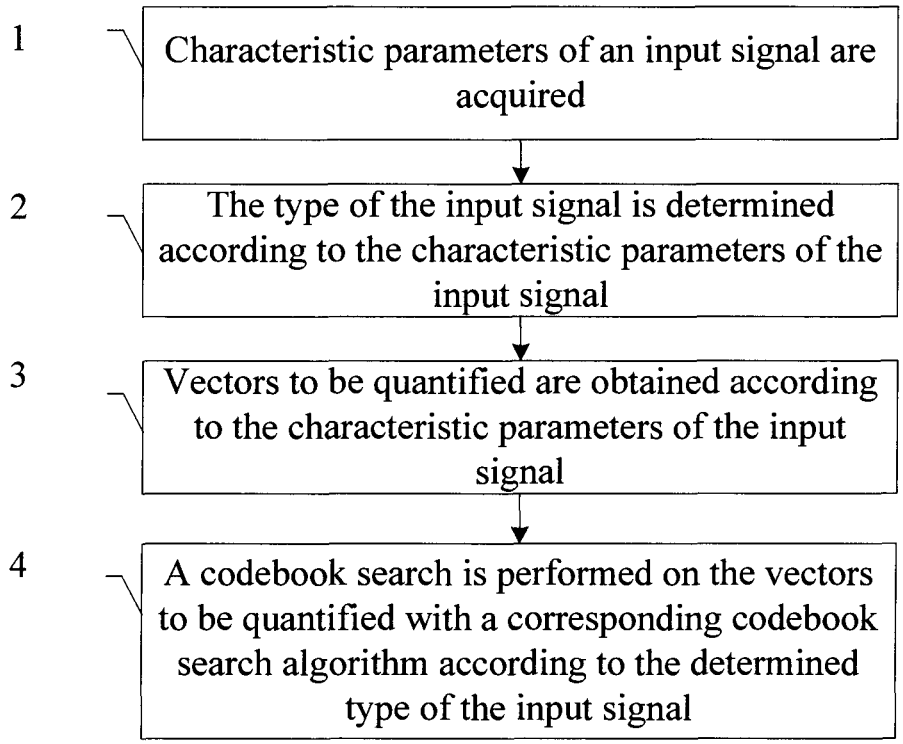
FIG. 2 is a flow chart of a coding method according to an embodiment of the present disclosure.

Referring to FIG. 2, the coding method in an embodiment of the present disclosure includes the following blocks.

In Block 1, characteristic parameters of an input signal are acquired.

In this embodiment, the input signal for coding may be a residual signal after adaptive filtering based on a CELP model as well as other similar speech or musical tone signals applicable to vector quantization coding. Here, the characteristic parameters are data adapted to describe characteristics of the input signal in certain aspects. The characteristic parameters are analyzed and extracted in frames, and the frame size may be selected according to actual requirements and signal characteristics.

The characteristic parameters include, but are not limited to, linear prediction coefficient (LPC), linear prediction cepstrum coefficient (LPCC), pitch period coefficient, frame energy, and average zero-crossing rate.

In Block 2, the type of the input signal is determined according to the characteristic parameters of the input signal.

When the type of the input signal is determined, as the characteristic parameters are in various types, which respectively reflect characteristics of the input signal in certain aspects, the input signal may be classified based on different determination manners, for example, based on different characteristic parameters or combinations of the characteristic parameters, or by setting different threshold values for the characteristic parameters, which is not limited in this embodiment and may be set according to actual requirements.

As the classification of the signal type is closely related to the subsequent selection of the search algorithm, an applicable classification mode is to determine specific characteristic parameters as references for the classification and classification criteria according to characteristics of the candidate search algorithms.

For example, algorithms with a low computation complexity are suitable for processing input signals with periodic characteristics, as it is relatively easy to determine the position of an optimal pulse for this type of signals, thereby effectively lowering the complexity without significantly affecting the system performance. Besides, algorithms with a high computation complexity are suitable for processing input signals with white noise characteristics, as it is hard to determine the position of an optimal pulse for this type of signals, so that a high quality algorithm may be used to ensure the coding quality. Therefore, characteristic parameters that reflect the periodic characteristics of the input signal may be taken as references for classification, and the type of the input signal is classified into a type with periodic characteristics and a type with white noise characteristics. As such, the signal with periodic characteristics is processed by a search algorithm with a low complexity, and the signal with white noise characteristics is processed by a search algorithm with a high complexity.

Certainly, characteristic parameters that reflect other characteristics of the input signal may be adopted as auxiliary references for classification or to further subdivide the classification. A classification and determination method is given below as an example for illustration.

The input signal may be classified into four different frame types, namely, an unvoiced frame, a voiced frame, a general frame, and a transition frame. The voiced frame and the transition frame may be integrated into one type. The unvoiced frame and the general frame belong to the type with white noise characteristics, and the voiced frame and the transition frame belong to the type with periodic characteristics.

The pitch period coefficient, for example, average magnitude difference function (AMDF), may be employed to evaluate the periodic characteristics of the input signal, so as to preliminarily distinguish the type with periodic characteristics from the type with white noise characteristics. Certainly, the average zero-crossing rate may be used independently or as an aid for determination, and generally the average zero-crossing rate of a periodic signal is smaller than that of a white noise signal.

In the type with white noise characteristics, frame energy may be used to determine an unvoiced frame and a general frame. Generally, the frame energy of the unvoiced frame is lower than that of the general frame, and threshold values may be set for determination.

In the type with periodic characteristics, the AMDF may be further analyzed to distinguish a voiced frame and a transition frame, or a subdivided value range of the average zero-crossing rate is employed for distinguishing. If the voiced frame and the transition frame are integrated into one type, the subdivision is unnecessary.

The above classification and determination method is only exemplary, and appropriate characteristic parameters and determination sequences may be selected according to actual requirements and signal characteristics. For example, a classification is first made according to the frame energy, and then a subdivision is performed with structural characteristic parameters.

In Block 3, vectors to be quantified are generated according to the characteristic parameters of the input signal.

This block may be carried out in the same manner as the prior art. Moreover, Block 3 has no logical association with Block 2 in terms of the sequence, and may be performed before/after Block 2 or together with Block 2.

In Block 4, a codebook search is performed on the vectors to be quantified with a corresponding codebook search algorithm according to the determined type of the input signal.

The codebook search algorithm is configured according to the classification of the type of the input signal, so as to meet the characteristics of the signal.

For example, the signal classification method based on Block 2 has the following functions.

A codebook search algorithm having a high complexity and good performance is adapted to process the unvoiced frame signal, for example, a random codebook search algorithm or the depth-first tree search algorithm described in the background of the disclosure.

A codebook search algorithm having a high complexity and good performance is adapted to process the general frame, for example, the depth-first tree search algorithm described in the background of the disclosure.

A codebook search algorithm having a low complexity is adapted to process the voiced frame and/or the transition frame signal, for example, a codebook search algorithm based on pulse position replacement, particularly the global pulse replacement algorithm described in the background of the disclosure. If the voiced frame and the transition frame are further classified into two different types of signals, these two frames may also be processed with different codebook search algorithms.

After the codebook search algorithm is selected, a codebook search is performed on the vectors to be quantified with the determined codebook search algorithm.

Figure 3:
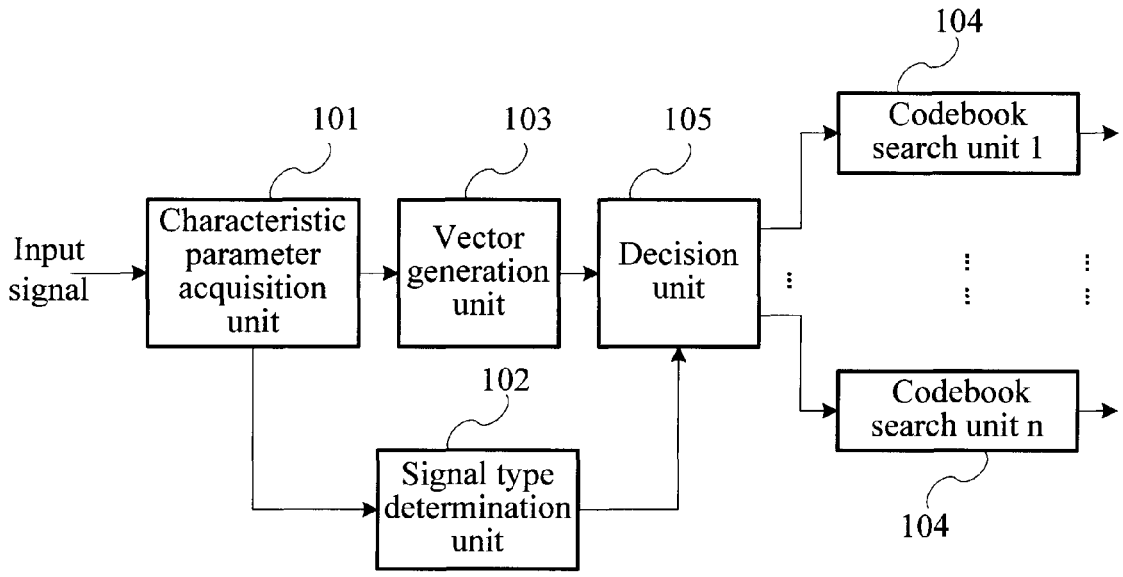
FIG. 3 is a schematic view of a logic structure of an encoder according to an embodiment of the present disclosure.

An encoder that implements the aforementioned coding method is described below in an embodiment of the present disclosure. Referring to FIG. 3, the encoder includes a characteristic parameter acquisition unit 101, a signal type determination unit 102, a vector generation unit 103, at least two codebook search units 104, and a decision unit 105.

The characteristic parameter acquisition unit 101 is adapted to acquire characteristic parameters of an input signal.

The signal type determination unit 102 is adapted to determine a type of the input signal according to the characteristic parameters provided by the characteristic parameter acquisition unit 101.

The vector generation unit 103 is adapted to generate vectors to be quantified according to the characteristic parameters provided by the characteristic parameter acquisition unit 101.

The at least two codebook search units (for example, codebook search units 1 to n are provided in this embodiment, which are uniformly marked by 104 in FIG. 3) are adapted to provide different codebook search algorithms (for example, a codebook search unit 1 provides a depth-first tree search algorithm, and a codebook search unit 2 provides a codebook search algorithm based on pulse position replacement).

The decision unit 105 is adapted to select a corresponding codebook search algorithm (for example, a codebook search unit 104 is selected in this embodiment), and perform a codebook search on the vectors to be quantified generated by the vector generation unit 103 with the selected codebook search algorithm according to the type of the input signal determined by the signal type determination unit 102. For example, if the decision unit 105 determinates that the type of the input signal is a type with periodic characteristics, the codebook search unit 2 is selected for performing a codebook search, and if the decision unit 105 determines that the type of the input signal is a type with white noise characteristics, the codebook search unit 1 is selected for performing a codebook search.

It should be noted that the two codebook search units in this embodiment are optional, and as such, the decision unit is adapted to select a corresponding codebook search algorithm and perform a codebook search on the vectors to be quantified with the selected algorithm according to the type of the input signal determined by the signal type determination unit.

Based on the above example of signal classification described in the method embodiment, the type of the input signal determined by the signal type determination unit 102 includes a type with periodic characteristics and a type with white noise characteristics.

The codebook search units 104 include a first-class codebook search unit and a second-class codebook search unit, and the computation complexity of the codebook search algorithm provided by the first-class codebook search unit is lower than that of the codebook search algorithm provided by the second-class codebook search unit. The decision unit 105 is adapted to select the first-class codebook search unit according to the type with periodic characteristics and select the second-class codebook search unit according to the type with white noise characteristics.

Further, based on the above example of signal classification described in the method embodiment, the type with white noise characteristics determined by the signal type determination unit 102 includes an unvoiced frame and a general frame, and the type with periodic characteristics determined by the same unit includes a voiced frame and/or a transition frame.

The second-class codebook search unit in the codebook search unit 104 includes a random codebook search unit and a depth-first search unit. The random codebook search unit is adapted to provide a random codebook search algorithm, and the depth-first search unit is adapted to provide a depth-first tree search algorithm. The first-class codebook search unit in the codebook search unit 104 includes a pulse replacement search unit adapted to provide a codebook search algorithm based on pulse position replacement.

The decision unit 105 is adapted to select the depth-first search unit according to the general frame and/or the unvoiced frame, and select the pulse replacement search unit according to the voiced frame and/or the transition frame.

The aforementioned coding method or device in the embodiment of the disclosure adopts different codebook search algorithms according to varied types of input signals. As an appropriate search algorithm may be selected according to all possible structural features of the input signal, certain types of signals for satisfactory results may be obtained through simple computations that may match with search algorithms suitable for these signal types and having low computation complexities, so as to achieve better performance with fewer system resources. Meanwhile, other types of signals that need complicated computations may be processed by more sophisticated search algorithms, thereby ensuring the coding quality.

In order to provide better coding performance, a codebook search algorithm based on pulse position replacement is described below. This algorithm has a low complexity but good performance, and is applicable to the coding technology of the disclosure.

Figure 4:
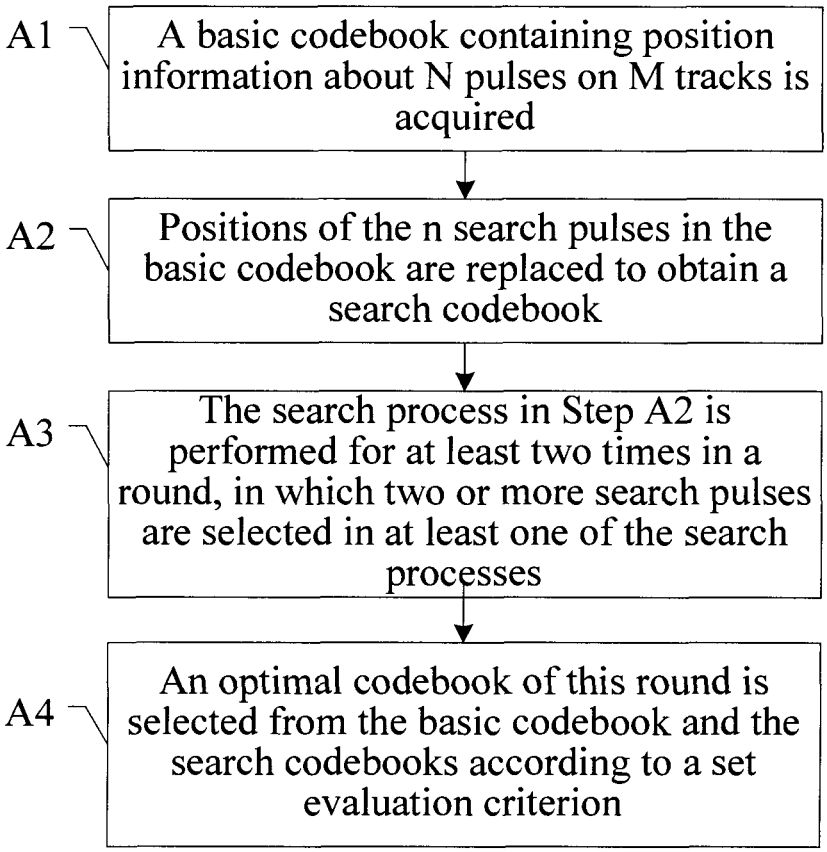
FIG. 4 is a flow chart of a codebook search algorithm according to a first embodiment of the present disclosure.

FIG. 4 shows the codebook search algorithm according to a first embodiment of the present disclosure, which includes the following blocks.

In Block A1, a basic codebook is acquired. The basic codebook includes position information about N pulses on M tracks, where N and M are positive integers.

Here, the basic codebook is an initial codebook functioning as a base for a round of search. Generally, before searching pulse positions in an algebraic codebook, the quantity distribution of pulses to be searched on each track has been determined according to information such as the bit rates. Taking a pulse search in the speech quantization coding for example, it is assumed that 64 positions are divided into M=4 tracks according to the manner shown in Table 1, namely, T0, T1, T2, and T3, so that based on different bit rates, the quantity distribution of the pulses may be: N=4, and one pulse is searched on each track; N=8, and two pulses are searched on each track; or N=5, one pulse is searched on T0, T1, and T2 respectively, while two pulses are searched on T3.

After the quantity distribution of the N pulses on the M tracks is determined, a basic codebook is obtained, that is, an initial position of each pulse on each track is obtained. The initial position of each pulse may be determined in various manners, which is not limited in the codebook search algorithm of this embodiment. For example, several manners are described as follows:

1) A position of the pulse on the track is randomly selected as the initial position of the pulse;

2) The position of each pulse on the corresponding track is determined according to several extreme values of a known reference signal on each track; and 3) The initial position of each pulse is obtained through a certain computation mode (that is, by using a basic codebook).

In addition, an optional reference signal is "pulse position maximum likelihood function" (also referred to as pulse amplitude selection signal). This function is denoted by:

$$b(i) = \sqrt{\frac{E_d}{E_r}} \times r_{LTP}(i) + a \times d(i), \quad i = 0, \ldots, 63$$

where d(i) is a component of a vector signal d in each dimension determined by a target signal to be quantified, which is typically a convolution of the target signal and a pulse response of a pre-filtered weighted synthesis filter; $r_{LTP}$(i) is a long-term predicted component of a residual signal r in each dimension; $E_d$ is the energy of the signal d; $E_r$ is the energy of the signal r; and a is a proportional factor, which controls the dependence degree of the reference signal d(i) and varies in value with different bit rates. Different values of b(i) on the 64 positions may be computed, and the position with the maximum value of b(i) on T0 to T3 is selected as the initial position of the pulse.

In Block A2, n pulses are selected as search pulses. The n pulses are a part of the N pulses, and n is a positive integer smaller than N. The specific implementation is: selecting n pulses from Ns pulses as search pulses, in which the Ns pulses are all of or a part of the N pulses, Ns is a positive integer smaller than or equal to N, and n is a positive integer smaller than Ns; and fixing positions of the pulses other than the n search pulses in the basic codebook, and replacing positions of the n search pulses with other positions on the track respectively to obtain a search codebook.

The pulses that may be selected as the search pulses may be all of or just a part of the N pulses, and "the pulses that may be selected as the search pulses" form an "Ns set". In a certain sense, if the N pulses include pulses that do not belong to the Ns set, the positions of these pulses are already optimal and do not need to be searched any more.

The n search pulses may be selected from the Ns pulses in various manners, which are not limited in the codebook search algorithm of this embodiment. For example, several manners are described as follows:

1) The value of n and the combinations of the search pulses are randomly selected.

It is assumed that the Ns set altogether has 3 pulses, namely, P0, P1, P2, and the possible combinations include: n=1, taking P1 as the search pulse; n=2, taking P0 and P2 as the search pulses; and n=2, taking P1 and P2 as the search pulses and the like.

2) The value of n is determined (n≥2), and the combinations of the search pulses are randomly selected.

It is assumed that the Ns set altogether has 4 pulses, namely, P0, P1, P2, P3, and n=3, so that the possible combinations include: P0, P1, P2; P0, P2, P3; P0, P1, P3; and P1, P2, P3, which respectively serve as the search pulses.

After the combination of the search pulses is selected, corresponding positions of the n search pulses in the basic codebook are replaced by other positions on the track where the search pulses are located to obtain a search codebook.

It is assumed that the basic codebook altogether has N=4 pulses, namely, P0, P1, P2, P3, which are respectively located on M=4 tracks, namely, T0, T1, T2, T3, and one pulse is searched on each track. If the selected search pulses are P2, P3 in a search process, the positions of P0, P1 in the basic codebook are fixed, the positions of P2 are respectively replaced by other positions on T2 (for example, t2 positions in total), and the positions of P3 are respectively replaced by other positions on T3 (for example, t3 positions in total), so that altogether $(t2+1)\times(t3+1)-1=t2\times t3+t2+t3$ search codebooks are obtained. It should be noted that, the positions used for replacement on the searched track may be all positions on the track or be selected from a set range, for example, a part of the positions are selected for replacement from the searched track according to the value of a known reference signal.

In Block A3, the search process in Block A2 is performed for K times in a round, and K is a positive integer greater than or equal to 2. Two or more search pulses are selected in at least one search process, and the search pulses selected in each search process are not completely the same.

In Block A2, the cycling times K may be an upper limit set specifically, and a round of search is completed when the search process is performed for K times.

Moreover, the embodiment of the present disclosure may not necessarily limit the value of K. That is, the value of K is not determined, and whether a round of search is completed is determined according to a certain search termination condition. For example, when the selected search pulses have traversed the Ns set, it is determined that a round of search is completed. Certainly, the above two manners may also be integrated, i.e., whether a round of search is completed is determined based on whether or not a search termination condition is satisfied, and meanwhile, the search times may not exceed the set upper limit of K. If the value of K has reached the upper limit, it is considered that a round of search is completed even if the search termination condition is not satisfied. Specific rules may be set according to actual requirements, which is not limited in the codebook search algorithm of this embodiment.

In order to reflect the association between the pluses in the search result, the codebook search algorithm in this embodiment requires that at least one of the K times of search processes is performed on two or more pulses, and the selected search pulses may be distributed on the same or different tracks.

In Block A4, an optimal codebook of this round is selected from the basic codebook and the search codebooks according to a set evaluation criterion.

The comparison and evaluation process of the search codebook and the basic codebook may be carried out at the same time with the search process in Block A2. For example, a "preferred codebook" is set and then initialized into a basic codebook. After that, a search codebook is obtained and compared with the current preferred codebook for evaluation. If it is determined that the search codebook is superior to the preferred codebook, the current preferred codebook is replaced by the search codebook. The above process is repeated until all K times of searches are completed, and the finally obtained preferred codebook is the optimal codebook of this round. It should be noted that each search process is based on the basic codebook, and only the preferred codebook is compared and evaluated.

The results of the K times of search processes may also be evaluated collectively. For example, the preferred codebook obtained after each search process is saved, and the K preferred codebooks are compared to select the optimal codebook of this round.

The comparison and evaluation criterion for the search codebook and the basic codebook is determined according to actual requirements, which are not limited in the codebook search algorithm of this embodiment. For example, a cost function (Qk) usually adapted to measure the quality of an algebraic codebook may be employed for comparison. Generally, in such an embodiment, the larger the Qk value is, the better the codebook quality will be, so that the codebook with a larger Qk value may be selected as the preferred codebook.

Figure 5:
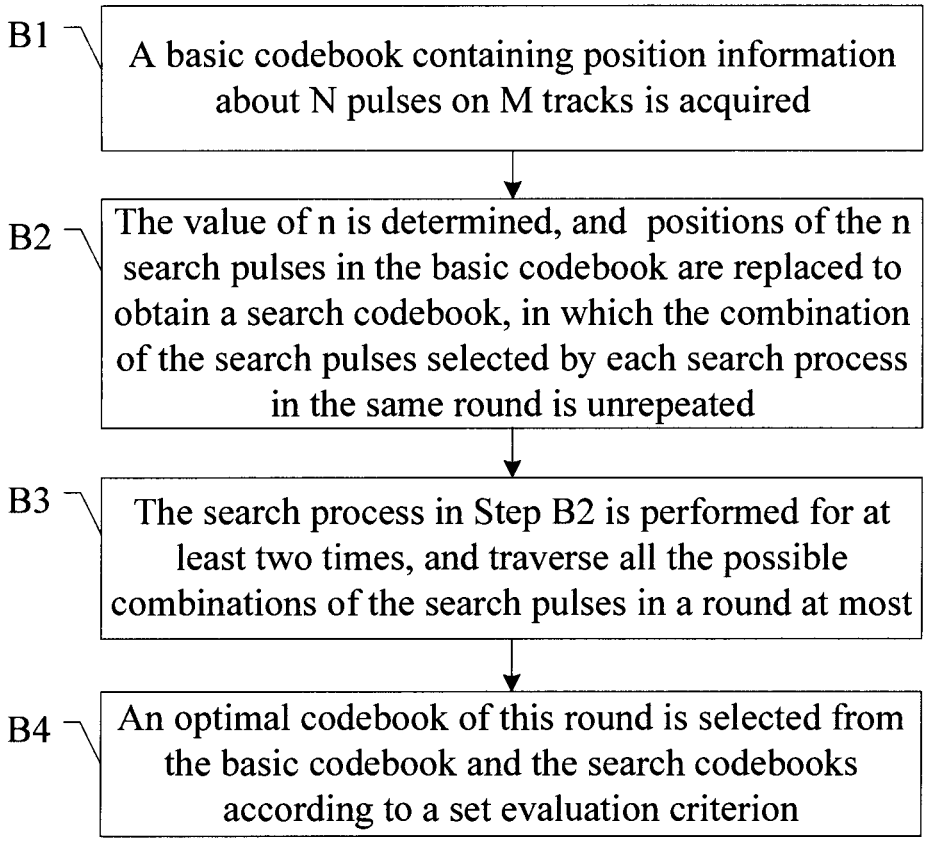
FIG. 5 is a flow chart of a codebook search algorithm according to a second embodiment of the present disclosure.

FIG. 5 shows the codebook search algorithm according to a second embodiment of the present disclosure on the basis of the first embodiment, which includes the following blocks.

In Block B1, a basic codebook is acquired. The basic codebook includes position information about N pulses on M tracks, where N and M are positive integers.

This block may be performed similarly to Block A1 in the first embodiment of the codebook search algorithm.

In Block B2, n=n0 search pulses are selected from the Ns pulses; the definition of Ns is the same as that in the first embodiment of the codebook search algorithm; n0 is greater than or equal to 2, and remains unchanged in the current round of search; and the n0 search pulses are only one combination selected from total $C_{Ns}^{n}$ possible combinations without repetition.

It is assumed that the Ns set altogether has 4 pulses, namely, P0, P1, P2, P3, which are respectively on M=4 tracks, i.e., T0, T1, T2, T3, and one pulse is searched on each track. If it is determined that n=n0=2, and two search pulses are selected from the Ns set, there are altogether $C_{Ns}^{n}=6$ combinations, including P0, P1; P0, P2; P0, P3; P1, P2; P1, P3; and P2, P3. The search pulses may be randomly or sequentially selected from the six combinations. In order to make the selection unrepeated each time, the search pulses may be sequentially selected according to the change rules of the combinations; or, all the combinations are saved or numbered in order, and the selected combinations (or numbers) are then deleted.

In Block B3, the search process in Block B2 is performed for K times in a round, and $2\leq K\leq C_{Ns}^{n}$. Two or more search pulses are selected in at least one of the search processes, and the search pulses selected in each search process are not completely the same.

As the value of n is fixed, and the combination of the search pulses selected each time is unrepeated, all the possible combinations in the Ns set may be traversed after $C_{Ns}^{n}$ times of searches at the most. Certainly, the upper limit value of K may be restricted lower than $C_{Ns}^{n}$, and at this point, not all the possible combinations are traversed, but the selected search pulses may still traverse the Ns set.

In Block B4, an optimal codebook of this round is selected from the basic codebook and the search codebooks according to a set evaluation criterion.

This block may be performed similarly to Block A4 in the first embodiment of the codebook search algorithm.

Figure 6:
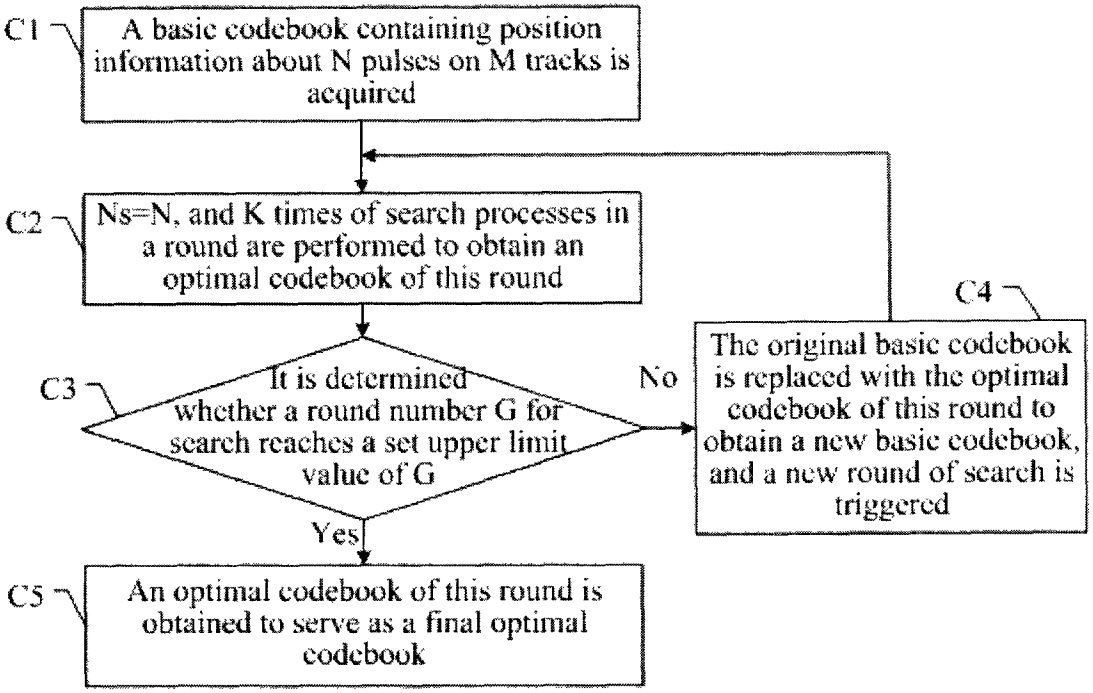
FIG. 6 is a flow chart of a codebook search algorithm according to a third embodiment of the present disclosure.

FIG. 6 shows the codebook search algorithm according to a third embodiment of the present disclosure, which provides a method capable of being performed repeatedly in multiple rounds based on the first and second embodiments of the codebook search algorithm. The method includes the following blocks.

In Block C1, a basic codebook is acquired. The basic codebook includes position information about N pulses on M tracks, where N and M are positive integers.

This block may be performed similarly to Block A1 in the first embodiment of the codebook search algorithm.

In Block C2, Ns=N, and K times of search processes are performed in a round to obtain an optimal codebook of this round.

This block may be performed similarly to Blocks A2 to A4 in the first embodiment of the codebook search algorithm, or similarly to Blocks B2 to B4 in the second embodiment of the codebook search algorithm. As Ns=N, the search pulses may be selected from all the pulses of the basic codebook. For the method in the second embodiment of the codebook search algorithm, the determined value of n may be the same or vary in different rounds.

In Block C3, it is determined whether a round number G for search reaches a set upper limit value of G, and if yes, Block C5 is performed; otherwise, Block C4 is performed.

In Block C4, the optimal codebook replaces the original basic codebook to serve as a new basic codebook, and the process returns to Block C2 to continue searching for an optimal codebook of a new round.

In Block C5, an optimal codebook of this round is acquired to serve as a final optimal codebook.

Figure 7:
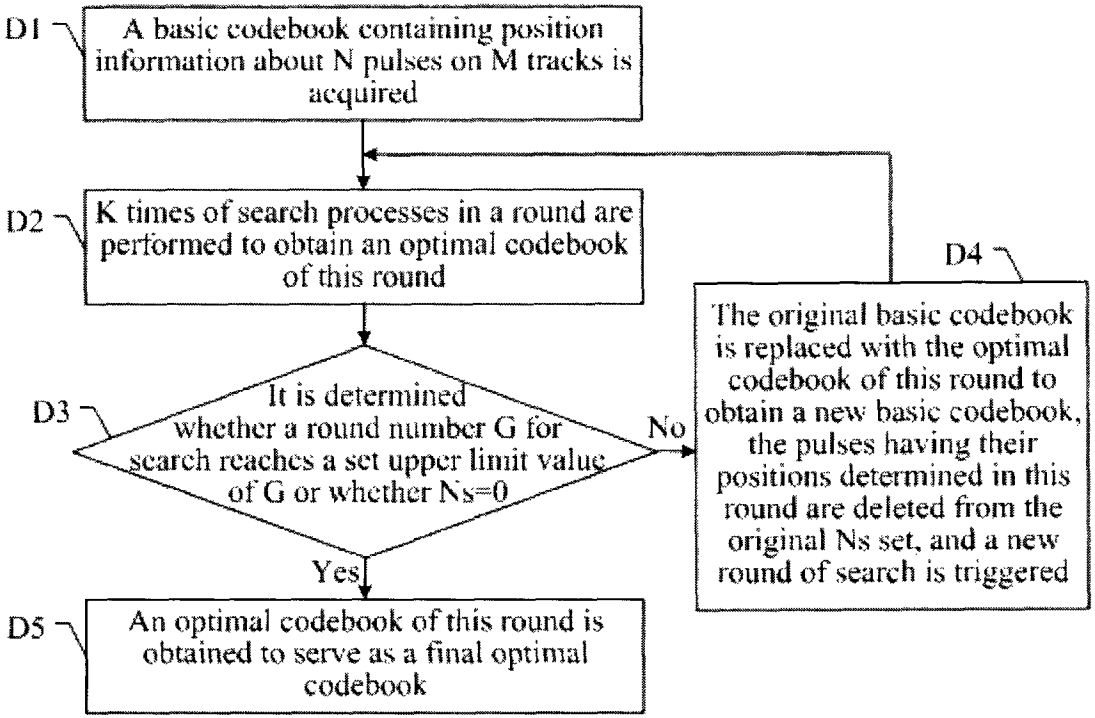
FIG. 7 is a flow chart of a codebook search algorithm according to a fourth embodiment of the present disclosure.

FIG. 7 shows the codebook search algorithm according to a fourth embodiment of the present disclosure, which provides another method capable of being performed repeatedly in multiple rounds based on the first and second embodiments of the codebook search algorithm. The method includes the following blocks.

In Block D1, a basic codebook is acquired. The basic codebook includes position information about N pulses on M tracks, where N and M are positive integers.

This block may be performed similarly to Block A1 in the first embodiment of the codebook search algorithm.

In Block D2, K times of search processes are performed in a round to obtain an optimal codebook of this round.

This block may be performed similarly to Blocks A2 to A4 in the first embodiment of the codebook search algorithm, or similarly to Blocks B2 to B4 in the second embodiment of the codebook search algorithm. In the first round, it is set that Ns=N.

In Block D3, it is determined whether a round number G for search reaches a set upper limit value of G or whether the Ns set in the next round is null, and if yes, Block D5 is performed; otherwise, Block D4 is performed.

In this embodiment of the codebook search algorithm, the Ns set of each round is determined according to the search result of the previous round, and the specific implementation is shown in Block D4. If the Ns set is null, the search is considered completed. Whether the search is completed or not may also be determined according to the set upper limit value of G when the Ns set is not null.

In Block D4, the optimal codebook replaces the original basic codebook to serve as a new basic codebook, so as to obtain pulses in the optimal codebook at fixed positions and belonging to the original Ns pulses to serve as the new Ns pulses. After that, the process returns to Block D2 to continue searching for an optimal codebook of a new round. It is assumed that Ns=N=4 in the first round of search, the Ns set altogether has 4 pulses, namely, P0, P1, P2, P3, which are respectively on M=4 tracks, i.e., T0, T1, T2, T3, and one pulse is searched on each track. If it is determined that n=n0=2 in the first round, K=6 times of searches are performed by traversing all the combinations of the search pulses as in the second embodiment of the codebook search algorithm. The combinations are: P0, P1; P0, P2; P0, P3; P1, P2; P1, P3; P2, P3. It is assumed that the optimal codebook of the first round is obtained by searching with the combination of P0, P3, and thus the pulses at fixed positions and belonging to the Ns set of the first round are P1, P2, so that the Ns set of the second round is P1, P2. If it is determined that n=n0=2 in the second round, K=1 time of search is performed. Apparently, the optimal codebook of the second round is obtained by searching with the combination of P1, P2, and the fixed pulses in this search are P0, P3. However, it is obvious that the two pulses do not belong to the Ns set of the second round, so that the Ns set in the third round is determined to be null, and the search is completed.

In Block D5, an optimal codebook of this round is acquired to serve as a final optimal codebook.

Figure 8:
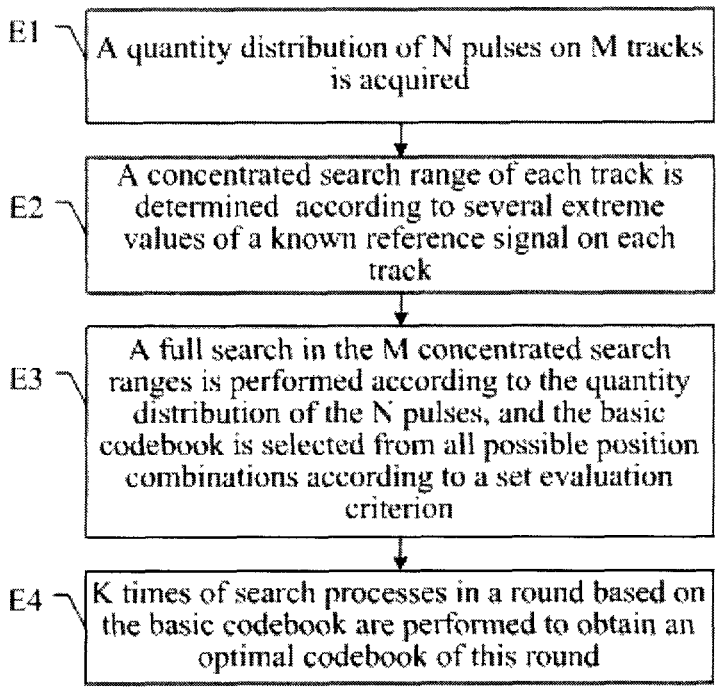
FIG. 8 is a flow chart of a codebook search algorithm according to a fifth embodiment of the present disclosure.

FIG. 8 shows the codebook search algorithm according to a fifth embodiment of the present disclosure, which provides a specific method for acquiring an initial basic codebook based on the above embodiments of the codebook search algorithm. The method includes the following blocks.

In Block E1, a quantity distribution of the N pulses on the M tracks is acquired.

That is, the total number N of the pulses to be searched and the number of the pulses distributed on each track are determined according to related information such as the bit rate.

In Block E2, a concentrated search range of each track is determined according to several extreme values of a known reference signal on each track, and the concentrated search range at least includes one position on the track.

The reference signal may adopt the pulse position maximum likelihood function b(i), compute different values of b(i) on all the pulse positions, and respectively select several positions with the maximum value of b(i) on each track as the concentrated search range of each track. The number of positions contained in the concentrated search range of each track may be the same or different.

For example, altogether M=4 tracks, i.e., T0, T1, T2, T3 are provided, the positions on each track are divided as shown in Table 1, and the pulse positions on each track are rearranged in a descending order according to absolute values of b(i). It is assumed that the rearranged track positions are:

```
{ T0, T1, T2, T3}=
{
 {0, 36, 32, 4, 40, 28, 16, 8, 20, 52, 44, 48, 12, 56, 24, 60},
 {1, 33, 37, 5, 29, 41, 17, 9, 49, 21, 53, 25, 13, 45, 57, 61},
 {34, 2, 38, 30, 6, 18, 42, 50, 26, 14, 10, 22, 54, 46, 58, 62},
 {35, 3, 31, 39, 7, 19, 27, 51, 15, 43, 55, 47, 23, 11, 59, 63}
 }
```

Thereby, if 4 positions with the maximum absolute value of b(i) on each track are selected as the concentrated search range of the track, the concentrated search range of the basic codebook is as follows:

```
{
 {0, 36, 32, 4},
 {1, 33, 37, 5},
 {34, 2, 38, 30},
 {35, 3, 31, 39}
 }
```

In Block E3, a full search is performed in the M concentrated search ranges according to the quantity distribution of the N pulses, and the basic codebook is selected from all possible position combinations according to the set evaluation criterion.

As the concentrated search range is generally very small, a full search may be performed to obtain an optimal basic codebook. For example, it is assumed that the basic codebook altogether has N=4 pulses, namely, P0, P1, P2, P3, which are respectively on M=4 tracks, i.e., T0, T1, T2, T3, and one pulse is searched on each track. As for the search ranges provided in Block E2, the basic codebook may be obtained after altogether 4×4×4×4=256 times of searches.

In Block E4, K times of search processes are performed in a first round based on the basic codebook to obtain an optimal codebook of this round.

This block may be performed similarly to Blocks A2 to A4 in the first embodiment of the codebook search algorithm, or similarly to Blocks B2 to B4 in the second embodiment of the codebook search algorithm.

In order to better understand the above embodiment of the codebook search algorithm, a computation example is given below.

For example, altogether N=4 pulses, i.e., P0, P1, P2, P3 respectively located on M=4 tracks, i.e., T0, T1, T2, T3 are provided, and one pulse is searched on each track. The positions on each track are divided as shown in Table 1, and the search process includes the following blocks.

1) In the method for computing an initial basic codebook according to the fifth embodiment of the codebook search algorithm, a full search is performed to obtain an initial basic codebook from the concentrated search range including 4 positions on each track, which for example is {32, 33, 2, 35}, and the required search times are 4×4×4×4=256.

2) A first round of search is performed; it is determined that n=n0=2, and K=6 times of searches are performed by traversing all the combinations of the search pulses as in the second embodiment of the codebook search algorithm. Each search is performed among 4 positions on one track and 12 positions on the other (the counted number of the positions already includes the pulse positions in the basic codebook, and the positions to be searched on the track are selected in a manner similar to the determination of the concentrated search range of the basic codebook). It is assumed that the optimal codebook obtained in the first round search is {32, 33, 6, 35}, which is obtained when the fixed pulses are P0, P1. The required search times are 6×(4×12)=288.

3) A second round of search is performed; it is determined that n=n0=2, the positions {6, 35} of P2, P3 are fixed, and K=1 time of search is performed on the combination of P0, P1. The search is respectively carried out among 4 positions on T0, T1. It is assumed that the optimal codebook obtained in the second round search is {32, 33, 6, 35}, and the required search times are 4×4=16.

4) It is determined that the Ns set of the search pulses is null, that is, all the positions of the pulses in the basic codebook are searched. The final optimal codebook is {32, 33, 6, 35}. The required search times are 256+288+16=560 in total.

The method provided in the above computation examples is applied to perform speech coding on a test sequence formed by 24 male sequences and 24 female sequences. The coding result is compared with the coding result of the existing depth-first tree search procedure in terms of objective speech quality, and the speech qualities obtained by the two methods are equivalent. However, the search times required in the above method is 560, which is much smaller than the search times of 768 required in the depth-first tree search procedure.

It is known from the aforementioned embodiments of the codebook search algorithm that, in the embodiments of the codebook search algorithm of the present disclosure, a replacement and search method is performed on different pulse combinations to select the optimal codebook, and at least one search is carried out on multiple pulses. As the optimal codebook is selected through replacement from different pulse combinations, the search times are reduced while ensuring the global sense of the search to the maximum. Moreover, as at least one search is performed on multiple pulses, the impact of the association between the pulses on the search result is considered, thus further ensuring the quality of the search result. If a method in which the value of n is fixed and different combinations of the search pulses are selected sequentially in a round of search is adopted, the selection of the search pulses is optimized, and the search process becomes more effective. Further, if all the possible combinations of the search pulses are traversed, the global sense of the search result is enhanced, and the quality of the search result is improved. If a multi-round search method is adopted to acquire the final optimal codebook, the quality of the search result is improved. The search method provided in the first or second embodiment of the codebook search algorithm may only be applied to a round of search, and other search methods are employed in the rounds before or after. When the multi-round search method is adopted to acquire the final optimal codebook, the range of the Ns set is reduced according to the search result of the previous round, which effectively reduces the amount of computation. If a concentrated search method is adopted to acquire the initial basic codebook, a high quality basic codebook is obtained, and the quality of the search result is further enhanced.

An experiment is performed on a classified encoder to evaluate the application effects of the coding method and encoder provided in the embodiments of the present disclosure. The encoder classifies the signals into unvoiced, general, voiced, and transition types, but all types of the input signals adopt a single fixed codebook search algorithm for search. In the experiment, the method of the present disclosure adopts a random codebook search algorithm to process the unvoiced frame, adopts a depth-first search algorithm to process the general frame, and adopts the method provided in the computation example of the codebook search algorithm of the present disclosure to process the voiced frame/transition frame. The experiment has the following conclusions by comparing processing results of different speech samples under different sampling rates:

1) The weighted segmental signal-to-noise ratio parameter in the coding method of the embodiment of the present disclosure is higher than that of the method in the original encoder for about 0.0245 on average.

2) The algorithm complexity of the coding method in the embodiment of the present disclosure is measured by million operations per second (MOPS), which is lower than the method in the original encoder for about 0.3185 MOPS on average.

3) The perceptual evaluation of speech quality (PESQ) of the coding method in the embodiment of the present disclosure is lower than the method in the original encoder for about 0.03%, i.e., 0.00127 mean opinion score (MOS), which may almost be ignored.

In view of the above, compared with the method in the original encoder, the coding method of the embodiment of the present disclosure is advantageous in having a lower complexity and better system performance.

Persons of ordinary skill in the art should understand that all or a part of the blocks of the method according to the embodiments of the present disclosure may be implemented through hardware under the instruction of a program. The program is executed in the following blocks: acquiring characteristic parameters of an input signal; determining a type of the input signal according to the characteristic parameters; obtaining vectors to be quantified according to the characteristic parameters; and performing a codebook search on the vectors to be quantified with a codebook search algorithm corresponding to the determined type of the input signal. The program may be stored in a computer readable storage medium, such as a ROM, a RAM, a magnetic disk, or an optical disk.

In view of the above, the coding method and the encoder of the present disclosure are described in detail. The principle and implementation of the present disclosure are illustrated with specific embodiments, and these embodiments are only intended to explain the method and ideas of the present disclosure. Persons of ordinary skill may make modifications and variations to the implementation and application range of the present disclosure without departing from the scope of the present disclosure. Therefore, the above descriptions are not intended to limit the present disclosure.

What is claimed is:

1. A coding method, comprising:

acquiring, by an encoder, characteristic parameters of an input signal, wherein the encoder is implemented by hardware;

determining, by the encoder, a type of the input signal according to the characteristic parameters, wherein the type of the input signal comprises a periodic characteristic or a white noise characteristic;

obtaining, by the encoder, vectors to be quantified according to the characteristic parameters; and performing, by the encoder, a codebook search on the vectors to be quantified with a codebook search algorithm corresponding to the type of the input signal, wherein the codebook search algorithm comprises a first-class codebook search algorithm when the type of the input signal comprises the periodic characteristic wherein the codebook search algorithm comprises a second-class codebook search algorithm when the type of the input signal comprises the white noise characteristic and wherein a computation complexity of the first-class codebook search algorithm is lower than a computation complexity of the second-class search algorithm.

2. The coding method according to claim 1, wherein the input signal comprises at least one of a general frame and an unvoiced frame when the type of the input signal comprises the white noise characteristic, and wherein the codebook search algorithm used by the general frame or the unvoiced frame is a depth-first tree search algorithm.

3. The coding method according to claim 2, wherein the input signal comprises at least one of a voiced frame and a transition frame when the type of the input signal comprises the periodic characteristic, and wherein the codebook search algorithm used by the voiced frame or the transition frame is a codebook search algorithm based on pulse position replacement.

4. The coding method according to claim 3, wherein the codebook search algorithm based on the pulse position replacement comprises:

obtaining a basic codebook which comprises position information of N pulses on M tracks, wherein N and M are positive integers;

selecting n pulses as search pulses, wherein the n pulses are included in the N pulses, and wherein n is a positive integer smaller than N;

replacing position information of the n pulses respectively with other position information on the tracks to obtain a searched codebook;

executing a search process K times, wherein K is a positive integer larger than or equal to 2, wherein at least two or more of the search pulses are chosen in one of the K search processes, and wherein the at least two or more of the search pulses vary in each of the K search processes; and obtaining an optimal codebook from the basic codebook and the searched codebook according to a preset criterion.

5. The coding method according to claim 4, wherein selecting the n pulses as the search pulses comprises:

selecting the n pulses from Ns pulses as the search pulses, wherein the Ns pulses comprise all of or a portion of the N pulses, wherein Ns is a positive integer smaller than or equal to N, and wherein n is a positive integer smaller than Ns; and fixing positions of pulses in the basic codebook other than the n search pulses.

6. The coding method according to claim 5, wherein selecting the n pulses from the Ns pulses as the search pulses comprises:

determining a value of n, wherein the value of n is larger than or equal to 2; and choosing one of all $C_{Ns}^{n}$ possible combinations without repetition in sequence or at random in each search process, wherein $K \leq C_{Ns}^{b}$.

7. The coding method according to claim 5, further comprising:

replacing an original basic codebook with the optimal codebook as a new basic codebook to obtain pulses in the optimal codebook at fixed positions and belonging to the Ns pulses to serve as new Ns pulses;

continuing a next round of searching for another optimal codebook; and repeating a process of replacing the original basic codebook with the optimal codebook until a round number G for search reaches an upper limit.

8. The coding method according to claim 5, wherein obtaining the basic codebook comprises:

acquiring a quantity distribution of the N pulses on the M tracks;

determining a concentrated search range of each of the tracks according to several extreme values of a known reference signal on each of the tracks, wherein the concentrated search range includes at least one position on the track;

performing a full search of the M tracks according to the quantity distribution of the N pulses; and selecting the basic codebook from all the position combinations according to the preset criterion.

9. An encoder, comprising:

a characteristic parameter acquisition unit configured to acquire characteristic parameters of an input signal;

a signal type determination unit configured to determine a type of the input signal according to the characteristic parameters, wherein the type of the input signal determined by the signal type determination unit comprises a periodic characteristic or a white noise characteristic;

a vector generation unit configured to generate vectors to be quantified according to the characteristic parameters;

a decision unit configured to perform a codebook search on the vectors to be quantified with a codebook search algorithm corresponding to the type of the input signal determined by the signal type determination unit; and at least two codebook search units, wherein each of the at least two codebook search units is configured to provide a different codebook search algorithm, wherein the at least two codebook search units comprise a first-class codebook search unit and a second-class codebook search unit, wherein a computation complexity of a codebook search algorithm provided by the first-class codebook search unit is lower than a computation complexity of a codebook search algorithm provided by the second-class codebook search unit, wherein the decision unit is configured to select the codebook search unit corresponding to the type of the input signal, wherein the decision unit is configured to select the first-class codebook search unit when the type of the input signal comprises the periodic characteristic, and wherein the decision unit is configured to select the second-class codebook search unit when the type of the input signal comprises the white noise characteristic.

10. The encoder according to claim 9 wherein the input signal comprises at least one of a general frame and an unvoiced frame when the type of the input signal comprises the white noise characteristic, wherein the second-class codebook search unit comprises a depth-first search unit configured to provide a depth-first tree search algorithm, and wherein the decision unit is configured to select the second-class codebook search unit according to the type with the white noise characteristic, and select the depth-first search unit according to the general frame or the unvoiced frame.

11. The encoder according to claim 9 wherein the input signal comprises at least one of a voiced frame and a transition frame when the type of the input signal comprises the periodic characteristic, wherein the first-class codebook search unit comprises a pulse replacement search unit configured to provide a codebook search algorithm based on pulse position replacement, and wherein the decision unit is configured to select the first-class codebook search unit according to the type with the periodic characteristic and select the pulse replacement search unit according to the voiced frame or the transition frame.

12. A non-transitory computer readable storage medium, tangibly embodying computer program code, which, when executed by a computer unit, causes the computer unit to perform a method comprising:

acquiring characteristic parameters of an input signal;

determining a type of the input signal according to the characteristic parameters, wherein the type of the input signal comprises a periodic characteristic or a white noise characteristic;

obtaining vectors to be quantified according to the characteristic parameters; and performing a codebook search on the vectors to be quantified with a codebook search algorithm corresponding to the type of the input signal, wherein the codebook search algorithm comprises a first-class codebook search algorithm when the type of the input signal comprises the periodic characteristic, where the codebook search algorithm comprises a second-class codebook search algorithm when the type of the input signal comprises the white noise characteristic, and wherein a computation complexity of the first-class codebook search algorithm is lower than a computation complexity of the second-class codebook search algorithm.

13. The non-transitory computer readable storage medium according to claim 12, wherein the input signal comprises at least one of a general frame and an unvoiced frame when the type of the input signal comprises the white noise characteristic, and wherein the codebook search algorithm used by the general frame or the unvoiced frame is a depth-first tree search algorithm.

14. The non-transitory computer readable storage medium according to claim 13, wherein the input signal comprises at least one of a voiced frame and a transition frame when the type of the input signal comprises the periodic characteristic, and wherein the codebook search algorithm used by the voiced frame or the transition frame is a codebook search algorithm based on pulse position replacement.

15. The non-transitory computer readable storage medium according to claim 14, wherein the codebook search algorithm based on the pulse position replacement comprises:

obtaining a basic codebook which comprises position information of N pulses on M tracks, wherein N and M are positive integers;

selecting n pulses as search pulses, wherein the n pulses are included in the N pulses, and wherein n is a positive integer smaller than N;

replacing position information of the n pulses respectively with other position information on the tracks to obtain a searched codebook;

executing a search process K times, wherein K is a positive integer larger than or equal to 2, wherein at least two or more of the search pulses are chosen in one of the K search processes, and wherein the at least two or more of the search pulses vary in each of the K search processes; and obtaining an optimal codebook from the basic codebook and the searched codebook according to a preset criterion.

16. The non-transitory computer readable storage medium according to claim 15, wherein selecting the n pulses as the search pulses comprises:

selecting the n pulses from Ns pulses as the search pulses, wherein the Ns pulses comprise all of or a portion of the N pulses, wherein Ns is a positive integer smaller than or equal to N, and wherein n is a positive integer smaller than Ns; and fixing positions of pulses in the basic codebook other than the n search pulses.

17. The non-transitory computer readable storage medium according to claim 16, wherein selecting the n pulses from the Ns pulses as the search pulses comprises:

determining a value of n, wherein the value of n is larger than or equal to 2; and choosing one of all $C_{Ns}^{n}$ possible combinations without repetition in sequence or at random in each search process, wherein $K \leq C_{Ns}^{b}$.

18. The non-transitory computer readable storage medium according to claim 16, further comprising:

replacing an original basic codebook with the optimal codebook as a new basic codebook to obtain pulses in the optimal codebook at fixed positions and belonging to the Ns pulses to serve as new Ns pulses;

continuing a next round of searching for another optimal codebook; and repeating a process of replacing the original basic codebook with the optimal codebook until a round number G for search reaches an upper limit.

19. The non-transitory computer readable storage medium according to claim 16, wherein obtaining the basic codebook comprises:

acquiring a quantity distribution of the N pulses on the M tracks;

determining a concentrated search range of each of the tracks according to several extreme values of a known reference signal on each of the tracks, wherein the concentrated search range includes at least one position on the track;

performing a full search of the M tracks according to the quantity distribution of the N pulses; and selecting the basic codebook from all the position combinations according to the preset criterion.

* * * * *

UNITED STATES PATENT AND TRADEMARK OFFICE

CERTIFICATE OF CORRECTION

PATENT NO. : 8,600,739 B2
APPLICATION NO. : 12/481060
DATED : December 3, 2013
INVENTOR(S) : Dejun Zhang et al.

It is certified that error appears in the above-identified patent and that said Letters Patent is hereby corrected as shown below:

Title Page 2, References Cited, under Other Publications, the following cited art should read:

"European Patent Office Communication pursuant to Article 94(3) EPC, European search opinion for Application No. 08800868.5-1224, mailed Apr. 26, 2010, Huawei Technologies Co., Ltd., 6 pgs.

Lee, Eung-Don, et al., "Efficient Fixed Codebook Search Method for ACELP Speech Codecs", Advance in Hybrid Information Technology: Lecture Notes in Computer Science, Nov. 9, 2006, Springer-Verlag Berlin Heidelberg, pp. 178-187."

In the Claims:

Column 15/Line 39 should read: "the input signal comprises the periodic characteristic,"

Column 15/Line 42 should read: "the input signal comprises the white noise characteristic,"

Column 17/Line 21 should read: "10. The encoder according to claim 9, wherein the input"

Column 17/Line 29 should read: "white noise characteristic and select the depth-first search"

Column 17/Line 31 should read: "11. The encoder according to claim 9, wherein the input"

Column 17/Line 58 should read: "prises the periodic characteristic, wherein the codebook"

Signed and Sealed this
Twenty-fifth Day of March, 2014

Michelle K. Lee

Michelle K. Lee
*Deputy Director of the United States Patent and Trademark Office*